US006655981B2

(12) United States Patent
Seki

(10) Patent No.: US 6,655,981 B2
(45) Date of Patent: Dec. 2, 2003

(54) JOINT CONNECTOR ASSEMBLY

(75) Inventor: Yoshinobu Seki, Aichi-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/892,501

(22) Filed: Jun. 28, 2001

(65) Prior Publication Data

US 2002/0001996 A1 Jan. 3, 2002

(30) Foreign Application Priority Data

Jun. 29, 2000 (JP) ..... P 2000-197164

(51) Int. Cl.[7] ..... H01R 4/24
(52) U.S. Cl. ..... 439/403; 439/417
(58) Field of Search ..... 439/403, 404, 439/402, 405, 417, 418, 98, 394, 701, 774, 772, 76.2

(56) References Cited

U.S. PATENT DOCUMENTS 3,708,779 A * 1/1973 Enright et al. ..... 439/99 R
4,193,201 A * 3/1980 Van Horn ..... 439/98
4,552,429 A * 11/1985 van Alst ..... 439/99 R
5,314,350 A * 5/1994 Matthews et al. ..... 439/404
5,338,220 A * 8/1994 Soes et al. ..... 439/403
5,722,851 A * 3/1998 Onizuka et al. ..... 439/404
5,888,088 A * 3/1999 Kobayashi et al. ..... 439/404
5,904,582 A * 5/1999 Markino et al. ..... 439/76.2
5,934,929 A * 8/1999 Saka et al. ..... 439/404
6,309,240 B1 * 10/2001 Daoud ..... 439/403

FOREIGN PATENT DOCUMENTS

JP 9-22745 1/1997

* cited by examiner

*Primary Examiner*—P. Austin Bradley
*Assistant Examiner*—Phuongchi Nguyen
(74) *Attorney, Agent, or Firm*—Finnegan, Henderson, Farabow, Garrett, & Dunner, L.L.P.

(57) ABSTRACT

An insulation displacement joint connector has a connector housing provided with a contact terminal into which a plurality of wires are press-fitted. The terminal is provided with wire fitting parts protruding from the connector housing. With the joint connector stacked on another joint connector with the same structure, the fitting parts of one joint connector are connected to wires in another joint connector by press fitting. Thus the use of a fewer number of joint connectors allows desired wire harness assembly, saving space and decreasing cost.

10 Claims, 3 Drawing Sheets

JOINT CONNECTOR ASSEMBLY

BACKGROUND OF THE INVENTION

1. Field of the Invention

This invention relates to an insulation displacement joint connector and joint connector assembly, and more particularly, to a plurality of insulation displacement joint connectors stacked on each other.

2. Description of the Related Art

Increasing variety of electrical loads in vehicles has been resulting in more complicated electrical systems. This requires increased efficiency in branching and connecting of wire harnesses to be connected to the respective loads. In a conventional wire harness connection, for example, two wire harnesses are connected by employing three joint connectors to establish circuitry.

Each wire harness in the connection includes two wires, for example, connected to each other with a joint connector. A wire in one wire harness and a wire in the other wire harness are connected with a joint connector to constitute circuitry in which all the four wires in the both wire harnesses are connected to each other.

The joint connector has a housing enclosing a contact with two insulation displacement claws. Two wires are press-fitted to the respective claws for connection.

With the above conventional joint connector, a further joint connector is used for connecting two different wire harnesses to each other, resulting in higher cost.

Further, in mounting the joint connector, it is required to spread the wires in the wire harnesses to recognize which wires to be connected, and to appropriately position the joint connector. This deteriorates workability in producing and mounting the wire harnesses.

SUMMARY OF THE INVENTION

It is therefore an object of the present invention to provide an insulation-displacement joint connector with good productivity and workability in mounting wire harnesses at low cost.

According to a first aspect of the invention, there is provided the following insulation displacement joint connector assembly. The assembly includes a plurality of stacked insulation displacement connectors. The connectors each includes a connector housing; and a contact terminal connected to a plurality of wires. The terminal has a plurality of first insulation displacing parts that are protruded from the connector housing and are pressed to wires in a neighboring connector for contact.

Preferably, the contact terminal further includes a plurality of second wire insulation displacing parts extending upright from the inner bottom wall of the connector housing. The first insulation displacing parts pass through the bottom wall and extend downward from the connector housing in the vertical direction.

Preferably, the contact terminal further includes a plurality of elongated plates each having the first insulation displacing part and the second insulation displacing part. The elongated plates being integrally connected with a connecting plate at a prescribed interval, the connecting plate being separable.

A second aspect of the invention provides the following wire harness. The wire harness includes a first insulated wire; and a second insulated wire. A conductive plate is interposed between the first insulated wire and the second insulated wire. The conductive plate has one side and another side. The connecting plate has the first insulated wire positioned on the one side. The conductive plate has the second insulated wire positioned on the another side. The conductive plate has a first end and a second end. The conductive plate includes a first displacing part of bent first end to extend to the first insulated wire to be pressed for contact; and a second displacing part of bent second end to extend to the second insulated wire to be pressed for contact.

Preferably, the conductive plate includes a base extending between the first displacing part and the second displacing part. The wire harness further includes: a connector housing accommodating the conductive plate, the connector housing including a first wall positioned between the first insulated wire and the second insulated wire. The first wall has the base positioned thereon.

Preferably, the second displacing part passes through the first wall.

Preferably, the connector housing further includes a cover made of a dielectric material. The base is fixed between the cover and the first wall.

Preferably, the connector housing further includes a second wall extending from the first wall toward the first insulated wire and over the first displacing part.

Preferably, the base and an end face of the second displacing part have a larger distance therebetween than an end face of the second wall and an end face of the first displacing part.

Preferably, the first displacing part has a cut at the first end.

Preferably, the second displacing part has a cut at the second end.

BRIEF DESCRIPTION OF THE ACCOMPANYING DRAWINGS

The above and further objects and novel features of the invention will more fully appear from the following detailed description when the same is read in conjunction with the accompanying drawings, in which.

DETAILED DESCRIPTION OF THE PREFERRED EMBODIMENT

With reference to the accompanying drawings, a preferred embodiment of this invention will now be described. In this embodiment, two insulation displacement joint connectors are used to connect wire harnesses.

Figure 1:
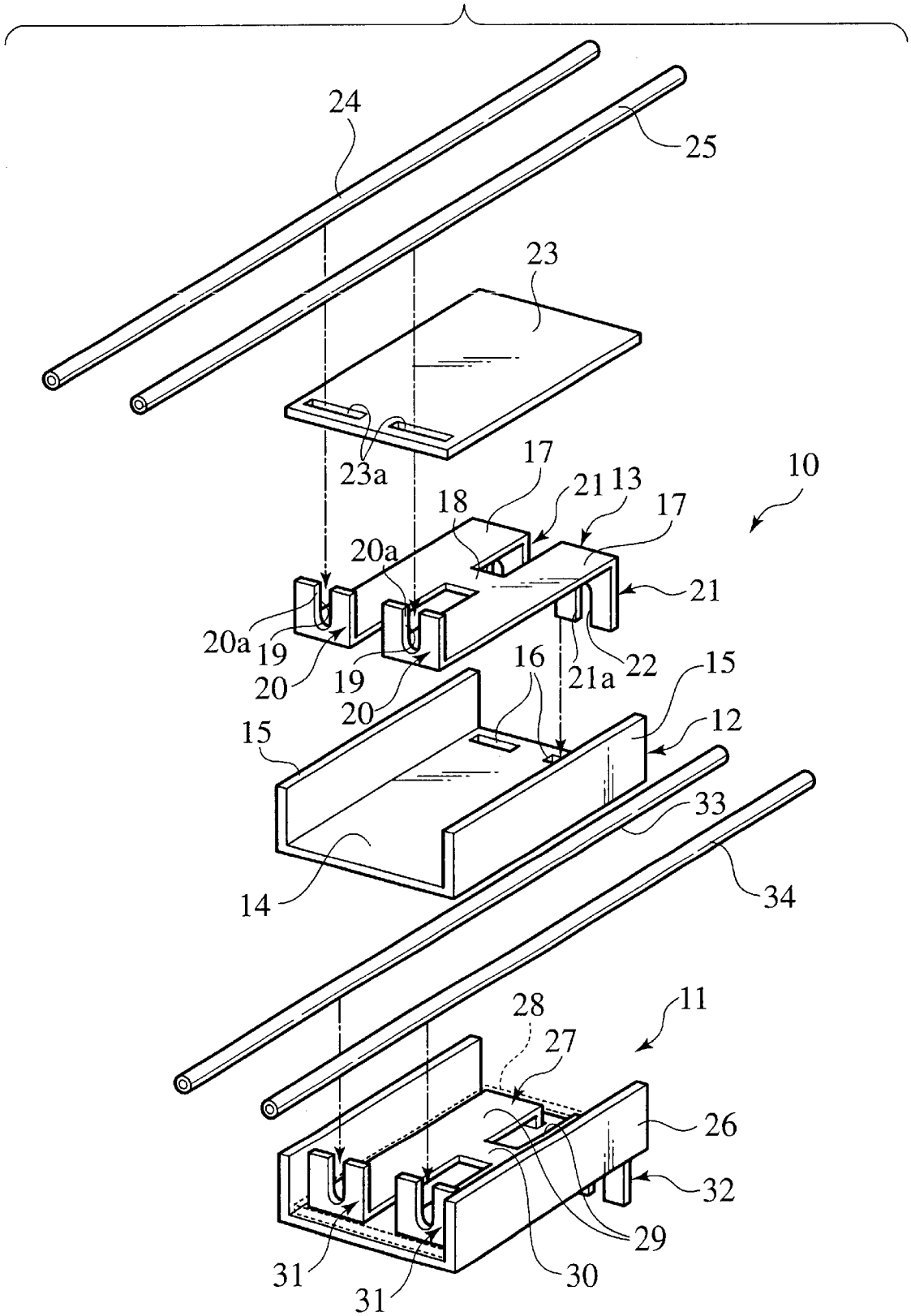
FIG. 1 is an exploded perspective view of an insulation displacement joint connector assembly according to an embodiment of this invention.

Referring to FIG. 1, a joint connector 10 consists generally of a connector housing 12 and an insulation displacement contact terminal 13.

The connector housing 12 is made of an electrical insulating synthetic resin, having a rectangular bottom plate 14 and opposed rectangular side plates 15, 15 extending upward from laterally both sides of the bottom plate 14. The bottom plate 14 is provided, at one side thereof, close to the edge, in the axis direction of a wire to be extended on the bottom plate 14, with a prescribed number (two in this embodiment) of elongated holes 16 passing through the plate 14 in the vertical direction and spaced at a prescribed interval.

The terminal 13 is made of a conductive metal plate that is press-molded to have, as a single unit, a plurality of (two in this embodiment) elongated plates 17 and a conductive plate 18 connecting the plates 17 to each other. One end 17*a* of the plate 17 is bent upright (on a side 17*f*)at a bending point 17*d* and is provided with a wire fitting part 20 with a notch 19 in U-shape that opens upward. The inner periphery 20*a* defining the notch 19 has a blade 20 *a* formed thereto.

The other end 17*b* of the plate 17 is bent vertically downward (on the opposite side 17*g*) at a bending point 17*e* and is provided with a wire fitting part 21 with a notch 22 in U-shape that opens downward. A blade 20*a* is provided at a periphery that defines the notch 22. The fitting part 21 of the terminal 13 has generally the same width as that of the elongated hole 16. The space between the fitting parts 21 is set generally the same as the space between the elongated holes 16.

The plate 17 has a base 17*c* extending between the bending points 17*d* and 17*e*.

A distance between a top surface 14*a* of the bottom plate 14 and the top end of the fitting part 20 is set at D1. A distance between the top surface 14*a* and the top end of the side plate 15 is set at D2. D1 is set smaller than D2.

A distance between the top end of the fitting part 20 and the top end of the side plate 15 is set at D3. A distance between a rear surface 14*b* of the bottom plate 14 and the top end of the fitting part 21 is set at D4. D4 is set larger than D3 and smaller than D2.

Figure 2:
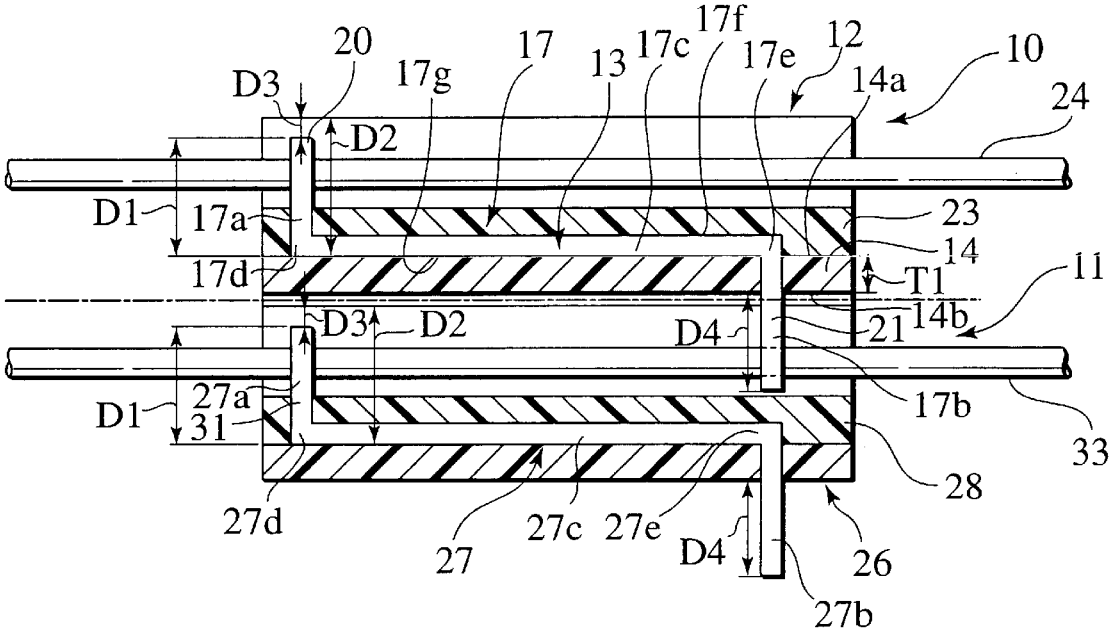
FIG. 2 is a sectional view of a main part of the assembled joint connectors according to the embodiment.

In the joint connector 10, the fitting parts 21 of the terminal 13 are inserted downwardly into the elongated holes 16 formed in the bottom plate 14 of the housing 12 to be accommodated in the housing 12. As shown in FIG. 2, an insulating plate 23 covering the terminal 13 is fixed to have the fitting parts 20 passing therethrough, laying along the bottom plate 14.

Wires 24 and 25 are press-fitted into the notches 19, 19 of the fitting parts 20, 20 of the joint connector 10 as shown in FIG. 1 so that insulations of the wires are split off by the blades 20*a*, 20*a* and the cores thereof are connected to the fitting parts 20.

The joint connector 11 has the same structure as that of the joint connector 10, consisting of connector housing 26, an insulation displacement contact terminal 27 and an insulating plate 28. As shown in FIG. 1, the terminal 27 is provided with elongated plates 29, a connecting plate 30, wire fitting parts 31 and 32. Wires 33 and 34 are connected to the fitting parts 31, 31.

Figure 3:
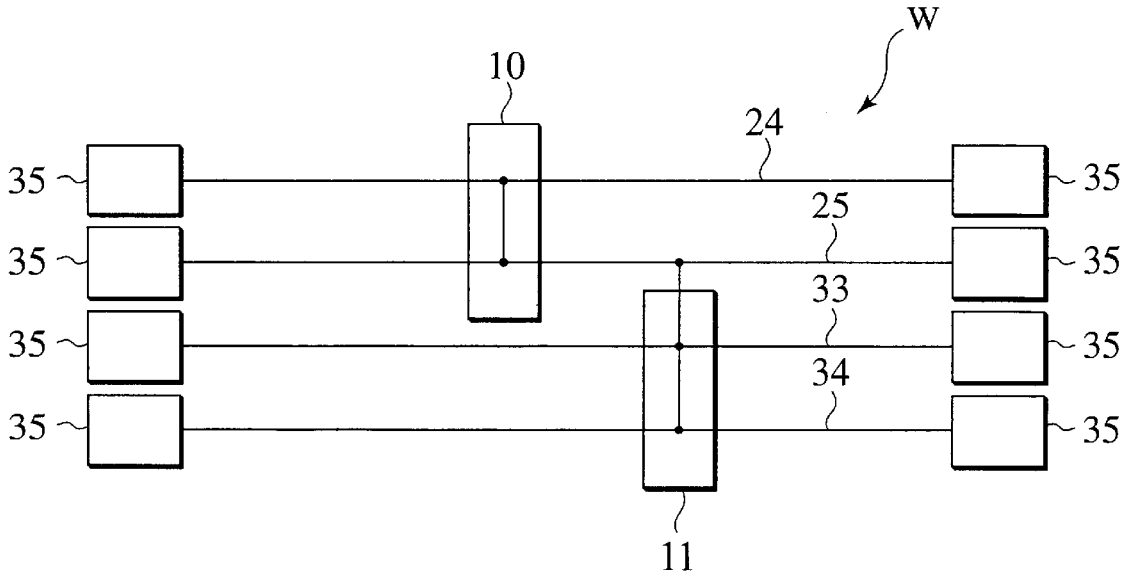
FIG. 3 is an equivalent circuit diagram of wire harnesses connected with the joint connectors according to the embodiment.

In this embodiment, the joint connectors 10 and 11 as shown in FIG. 1 are stacked as shown in FIG. 2, to have the fitting parts 21, 21 extending downwardly in the vertical direction from the bottom plate 14 of the joint connector 10 positioned above, connected to the wires 33 and 34 held in the joint connector 11 positioned below. This results in a wire harness assembly W having circuitry as shown in FIG. 3 with the wires 24, 25, 33 and 34 connected to each other. In FIG. 3, reference numeral 35 denotes a terminal connector.

In this state, since D4 is larger than D3 and smaller than D2, the fitting part 21 is connected to the wire 33 without contacting the bottom plate of the connector housing 26 (See FIG. 2).

This use of the joint connectors 10 and 11 in this embodiment allows establishing circuitry that had required three joint connectors, with two joint connectors 10 and 11. This embodiment having the joint connectors 10 and 11 stacked on each other allows saving space for a joint connector.

Figure 4:
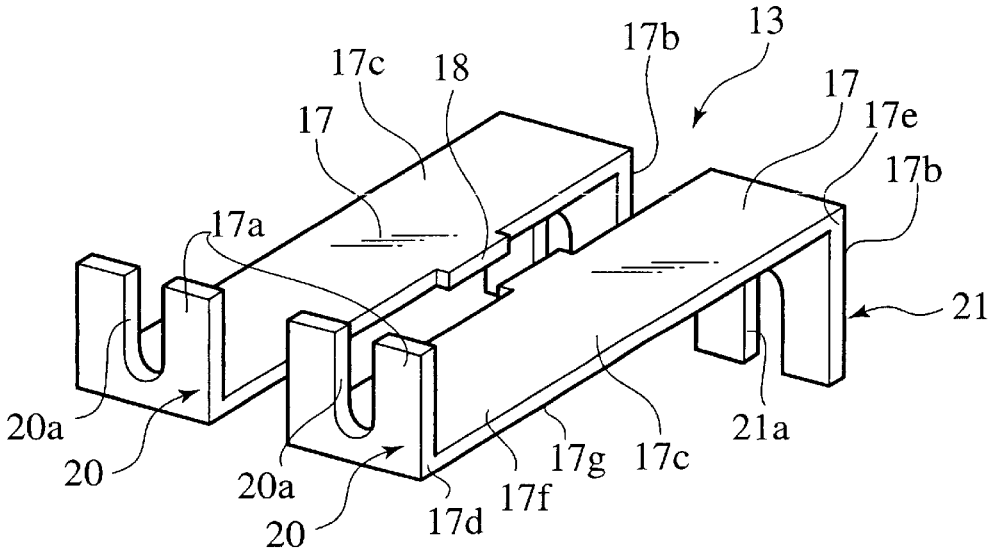
FIG. 4 is a perspective view of a joint connector separated according to a variant of the embodiment.
Figure 5:
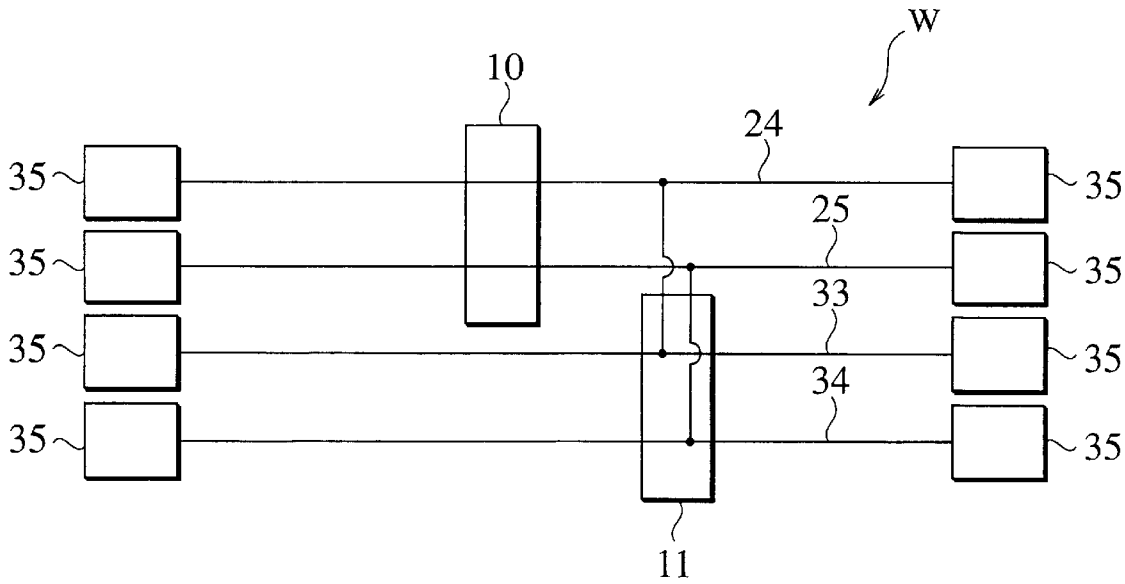
FIG. 5 is an equivalent circuit diagram of wire harnesses connected with the separated joint connectors in FIG. 4.

It is also possible to use the contact terminals 13 and 27 with the connecting plates 18 and 30 cut. FIG. 4 shows the connecting plate 18 of the terminal 13 separated so as to isolate the two elongated plates 17, 17 from each other. The isolation of the plates 17, 17 of the joint connector 10 from each other and the isolation of the plates 29, 29 of the joint connector 11 from each other allow producing a wire harness assembly W as shown in FIG. 5. It is also possible to produce circuitry in which the upper and lower joint connectors 10 and 11 are connected partially with each other by selectively bending or cutting off the fitting parts 21 and 32.

The above-described embodiment is not meant to limit this invention thereto. Various modifications may be made without departing from the spirit of this invention. For example, various design modifications are possible, including changes in the number of the elongated plates of the contact terminals and the structure of the connector housings.

As apparent from the above description, another connecting means for wires other than stacked joint connectors is not required, which provides reduction in the number of parts and space saving. Further, the simple stacking of the joint connectors allows easy production of wire harness assembly. Furthermore, use of the prescribed terminals allows positive production of wire harness assembly with desired circuitry.

A fitting part of a connector between stacked connectors is automatically connected to a wire in another connector, which increases workability in mounting to allow efficient production of wire harness assembly.

A plurality of elongated plates of the connector can be separated with a connecting plate cut, which increases the degree of freedom of design in circuitry to be established with the joint connectors.

The entire content of Japanese Patent Applications P2000-222978 (filed Jul. 24, 2000) is incorporated herein by reference.

What is claimed is:

1. An insulation displacement joint connector assembly comprising a plurality of stackable insulation displacement connectors, each connector comprising:

a connector housing; and a contact terminal having a first end and a second end, the first end including a plurality of first insulation displacing parts, each of the first insulation displacing parts protruded out of the connector housing and configured to receive a wire in a neighboring connector for electrical contact, the second end of the contact terminal comprising a plurality of second insulation displacing parts each extending upright with respect to the inner bottom wall of the connector housing, and wherein the first insulation displacing parts pass through the bottom wall and extend downward from the connector housing in the vertical direction.

2. An insulation displacement joint connector assembly as set forth in claim 1, wherein the contact terminal further comprises a plurality of elongated plates each having the first insulation displacing part and the second insulation displacing part, each of the elongated plates configured to connect to neighboring elongated plate with a removable connecting plate at a prescribed interval.

3. A wire harness assembly comprising:

a contact terminal having a top surface and a bottom surface, comprising:

at least one first insulated wire positioned above the top surface;

at least one second insulated wire positioned below the bottom surface;

at least one first displacing part extending from a first end of the contact terminal and configured to receive the first insulated wire for electrical contact;

at least one second displacing part extending from a second end of the contact terminal and configured to receive the second insulated wire for electrical contact; and a base extending between the first displacing part and the second displacing part; and a connector housing comprising:

a bottom wall positioned between the first insulated wire and the second insulated wire; and a side wall extending from the bottom wall toward the first insulated wire and over the first displacing part, wherein the connector housing accommodates the base therein.

4. A wire harness assembly as set forth in claim 3, wherein the distance between a bottom surface of the bottom wall and an end face of the second displacing part is greater than the distance between an end face of the side wall and an end face of the first displacing part.

5. A wire harness assembly as set forth in claim 3, wherein the distance between a top surface of the bottom wall and an end face of the first displacing part is less than the distance between the top surface of the bottom wall and an end face of the side wall.

6. A wire harness assembly comprising:

a connector housing having a bottom wall; and a contact terminal having a substantially flat top surface and a substantially flat bottom surface in opposite face of the top surface, comprising:

at least one first insulated wire positioned above the top surface;

at least one second insulated wire positioned below the bottom surface;

a plurality of first displacing patrs extending upright from the top surface and configured to receive the first insulated wire for electrical contact; and a plurality of second displacing parts extending from the bottom surface and configured to receive the second insulated wire for electrical contact, wherein the second displacing parts pass through the bottom wall of the connector housing and extend downward from the connector housing in the vertical direction.

7. A wire harness assembly as set forth in claim 6, wherein:

the contact terminal has a base extending between the first displacing parts and the second displacing parts; and the connector housing accommodates the base therein.

8. A wire harness assembly as set forth in claim 7, wherein the connector housing comprises a dielectric cover and the base is accommodated between the cover and the bottom wall.

9. A wire harness assembly as set forth in claim 6, wherein the first displacing parts include a notch having a blade.

10. A wire harness assembly as set forth in claim 6, wherein the second displacing parts include a notch having a blade.

* * * * *